US005177495A

United States Patent [19]

Davies

[11] Patent Number: 5,177,495

[45] Date of Patent: Jan. 5, 1993

[54] RADIO RECEIVER ANTENNA SYSTEMS

[75] Inventor: John Davies, Stockport, England

[73] Assignee: The General Electric Company, p.l.c., England

[21] Appl. No.: 439,177

[22] Filed: Nov. 20, 1989

[30] Foreign Application Priority Data

Nov. 23, 1988 [GB] United Kingdom ..... 8827411

[51] Int. Cl.[5] ..... H01Q 1/32

[52] U.S. Cl. ..... 343/713; 343/704; 455/273

[58] Field of Search ..... 343/713, 712, 704, 711, 343/852; 455/284, 10, 137, 273

[56] References Cited

U.S. PATENT DOCUMENTS

| | | | |
|---|---|---|---|
| 4,086,594 | 4/1978 | Kropielnicki et al. | 343/713 |
| 4,422,077 | 12/1983 | Kropielnicki | 343/713 |
| 4,654,669 | 3/1987 | Kropielnicki et al. | 343/713 |
| 4,761,826 | 8/1988 | Kropielnicki et al. | 343/713 |
| 4,868,890 | 9/1989 | Lennartsson | 455/137 |
| 4,903,034 | 2/1990 | Kropielnicki et al. | 343/713 |
| 4,903,035 | 2/1990 | Kropielnicki et al. | 343/713 |

FOREIGN PATENT DOCUMENTS

| | | |
|---|---|---|
| 0448147 | 6/1936 | United Kingdom . |
| 0881548 | 11/1961 | United Kingdom . |
| 2050118 | 12/1980 | United Kingdom . |
| 2180724 | 4/1987 | United Kingdom . |

*Primary Examiner*—Rolf Hille
*Assistant Examiner*—Hoanganh Le
*Attorney, Agent, or Firm*—Kirschstein, Ottinger, Israel & Schiffmiller

[57] ABSTRACT

A radio receiver antenna system including an antenna arrangement (1) which provides two signals ($v_a$, $v_b$) respectively as are provided by two antennas having different reception characteristics, and circuitry (T1, T2, 35 to 47) for combining the signals so that the output ($V_0$) is significant for all values of the relative phase of the two signals. A particular application is in vehicle radio receiver systems using the rear window heater as an antenna.

8 Claims, 2 Drawing Sheets

RADIO RECEIVER ANTENNA SYSTEMS

BACKGROUND OF THE INVENTION

1. Field of the Invention

This invention relates to radio receiver antenna systems.

2. Description of Related Art

A well-known problem with radio receivers is fading due to multiple path propagation. The problem arises particularly with mobile receivers when the receiver is in motion, especially when the receiver is for operation in the VHF band.

A known method of alleviating this problem is to use a so-called diversity reception technique. In this technique an antenna arrangement comprising two or more antennas having different reception characteristics, i.e. having receiving polar diagrams of different shape and/or orientation, is used, and the receiver is provided with a switching arrangement whereby the antenna producing the strongest signal at any one time is used as the receiver antenna. Instead of two or more antennas, a single antenna which can be caused by the switching arrangement to operate in different modes may be used.

SUMMARY OF THE INVENTION

It is an object of the present invention to provide a novel form of radio receiver antenna system for alleviating multiple path propagation fading.

According to the present invention a radio receiver antenna system comprises: an antenna arrangement which provides respectively at two terminals in response to a given transmitted signal two signals at the frequency of the transmitted signal as are respectively produced by two antennas having different reception characteristics; and means for producing an output at the frequency of the transmitted signal by combining the signals produced at said terminals in such manner that said output is significant for substantially all values of the relative phase of said two signals.

The combining means suitably comprises a combining circuit of the kind prima facie adapted to produce a significant output only when said two signals have one of the two relationships in-phase and anti-phase, but modified so as also to produce a significant output when said two signals have the other one of said two relationships.

In one particular embodiment of the invention said combining circuit comprises a radio frequency transformer having two windings across which said two signals are respectively applied, said windings having a non-unity turns ratio and the output of the system being derived from a tapping point on one of the windings.

In one such particular embodiment the relative sense of said windings is such that the fluxes produced by said windings are substantially anti-phase when said two signals are in phase, and vice versa.

In another particular embodiment of the invention said combining circuit comprises a differential amplifier circuit arrangement comprising: a pair of amplifying elements to whose control electrodes said two signals are respectively applied; a radio frequency transformer having first and second windings respectively connected in series with the main current paths through said amplifying elements, the relative sense of the first and second windings being such that the relative phase of the fluxes produced by said first and second windings is substantially the same as the relative phase of said two signals; an impedance connected between the control electrodes of said amplifying elements; a third winding of said transformer connected between a tapping point on said impedance and a point maintained at a reference potential, the sense of said third winding relative to the senses of said first and second windings being such that when said two signals are in phase the flux produced by said third winding opposes the fluxes produced by said first and second windings; and means for deriving an output from an impedance connected in series with the main current path through one of the amplifying elements.

BRIEF DESCRIPTION OF THE DRAWINGS

Two radio receiver antenna systems in accordance with the invention will now be described by way of example with reference to the accompanying drawings in which.

DETAILED DESCRIPTION OF THE PREFERRED EMBODIMENTS

Figure 1:
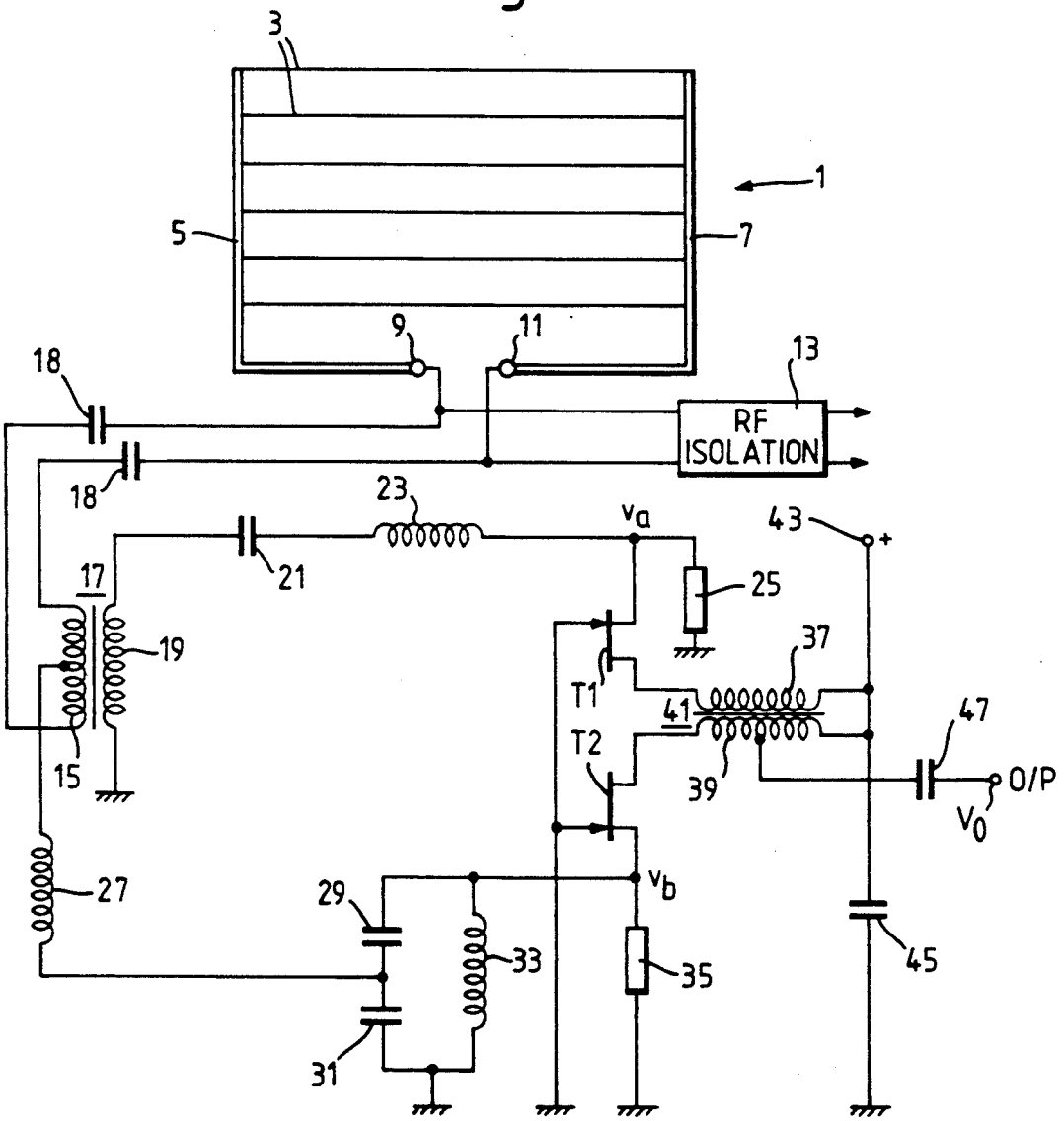
FIG. 1 is a circuit diagram of the first system.

The system of FIG. 1 is intended for use as a VHF antenna in a road vehicle and makes use of the rear window electric heater of the vehicle as an antenna.

Referring to FIG. 1, the antenna 1 comprises an array of parallel horizontal spaced resistance heating wires 3 mounted on the vehicle rear window (not shown) and joined at each end by a vertical conductor 5 or 7 of relatively low resistance also mounted on the window. The conductors 5 and 7 terminate below the wires 3 at terminals 9 and 11 respectively, positioned centrally of the heating wire array.

The terminals 9 and 11 are connected via a radio frequency isolation circuit 13 to the vehicle battery (not shown) for the supply of electric current to the wires 3 for heating purposes, as described for example in U.K. Patent No. GB-A-1520030.

For use of the wires 3 and conductors 5 and 7 as a radio antenna, the terminals 9 and 11 are also connected to opposite ends of a primary winding 15 of a radio frequency transformer 17 via dc blocking capacitors 18. The transformer 17 has a secondary winding 19 which is grounded at one end and has its other end connected via a series resonant circuit comprising a capacitor 21 and an inductor 23 to the source of a field-effect transistor T1 whose source is also connected to ground via a resistor 25. The resonant circuit 21, 23 is tuned to the frequency band over which the antenna system is required to operate.

The primary winding 15 has a cetnre tap connected via an inductor 27 to the junction between two capacitors 29, 31 connected in series across an inductor 33. One end of the inductor 33 is grounded and the other end is connected to the source of a second transistor T2 whose source is also connected to ground via a resistor 35. The components 27, 29, 31 and 33 form a second resonant circuit tuned to the antenna system operating frequency band.

The gates of the transistors T1 and T2 are connected to ground and the drains of the transistors T1 and T2 are respectively connected via primary and secondary windings 37 and 39 of a radio frequency transformer 41 to a terminal 43 at a positive potential with respect to ground to supply energizing current for the transistors T1 and T2, the terminal 43 being grounded to radio frequencies via a capacitor 45.

The output $V_o$ of the antenna system is derived from a tapping point on the winding 39 of the transformer 41 via a capacitor 47.

The windings 37 and 39 of the transformer 41 have a non-unity turns ratio, as further explained below.

In operation of the system, in response to a given transmitted signal, a first radio frequency signal $v_a$ appears between the source of transistor T1 and ground, and a second radio frequency signal $v_b$ appears between the source of transistor T2 and ground.

The signal $v_a$ arises from the antenna 1 acting in an unbalanced mode and the signal $v_b$ arises from the antenna acting in a balanced mode. Thus the signals $v_a$ and $v_b$ are respectively equivalent to those produced in response to a given transmitted signal by antennas of different reception characteristics and may be expected to vary in phase and amplitude differently as the vehicle moves. Thus the relative phase and relative amplitude of the signals $v_a$ and $v_b$ may be expected to change as the vehicle moves.

The transformer 41 serves as a combining circuit which combines amplified versions $V_a$ and $V_b$ of the signals $v_a$ and $v_b$ produced by the transistors T1 and T2, the combination being effected in such a manner that the output of the system is finite for all values of the relative phase and relative amplitude of the signals $v_a$ and $v_b$.

It will be understood that by combining the two signals in this manner, rather than merely selecting the stronger one of the two signals as is done in the prior art, an output signal of greater average power than in the prior art is obtained.

The operation of the combining circuit will now be explained with reference to FIGS. 2 and 3.

Figure 2:
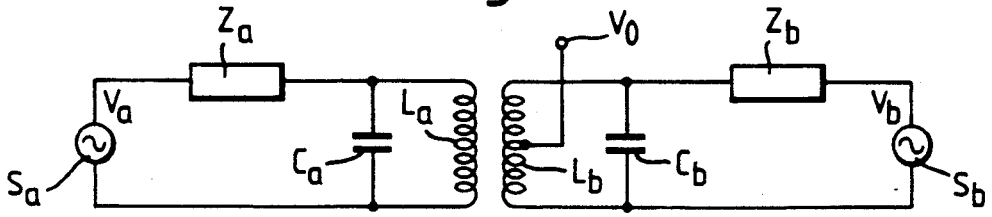
FIG. 2 is an equivalent circuit diagram of a combining circuit used in the first system.

FIG. 2 the signals $V_a$ and $V_b$ are represented as being produced by sources $S_a$ and $S_b$; $Z_a$, $Z_b$ and $C_a$, $C_b$ represent the output impedances and capacitances associated with these sources; $L_a$ and $L_b$ respectively represent the inductances of windings 37 and 39 of transformer 41; and N is the ratio of the number of turns of winding 37 to the number of turns of winding 39.

The voltages $V_a$ and $V_b$ may be represented as $$V_a = V \sin wt \tag{1}$$

$$V_b = rV \sin (wt+\phi) \tag{2}$$

where r and $\phi$ have values which change with time and vehicle motion in a random manner.

The combining circuit is required to operate so that the output voltage $v_\phi$ is never zero for any value of r and 0, provided of course that V is finite.

If the turns ratio N of transformer 41 is one, the combining circuit functions as a common-mode additive circuit which, when $V_a$ and $V_b$ are in phase ($\phi=0°$), produces an output $V_o$ proportional to the sum of $V_a$ and $V_b$, the total available power being equal to the sum of the available power from each source $S_a$, $S_b$ independently. However, when $V_a$ and $V_b$ are antiphase ($\phi=180°$) i.e. for differential-mode inputs, the output voltage $V_o$ will tend to zero as r tends to one. This occurs because the flux associated with the current produced in $L_a$ by $V_a$ opposes that associated with the current produced by $V_b$ in $L_b$, and $L_a$ and $L_b$ cease to operate as inductances and become effectively short circuits.

It can be seen that the required non-zero value for $V_o$ can be obtained by choosing a suitable non-unity value for N. The cancellation of flux, and consequent zero value for $V_o$ will then not occur since the flux created by each inductance $L_a$, $L_b$ is proportional both to the current in the inductance $L_a$ or $L_b$ and the number of turns in the inductance.

Figure 3:
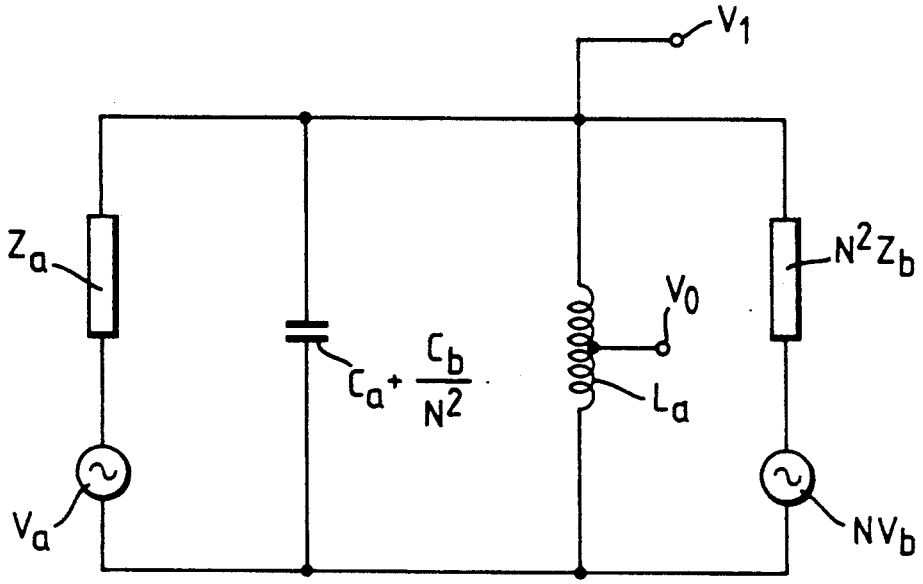
FIG. 3 is a simplified version of the equivalent circuit diagram of FIG. 2.

Operation of the combining circuit may be analyzed more closely by redrawing the equivalent circuit of FIG. 2 in the form shown in FIG. 3 where all components on the 'b' side of transformer 41 are referred to the 'a' side in accordance with transformer theory.

Referring to FIG. 3, it will be appreciated that the tapping point from which $V_o$ is taken is chosen merely to provide a desired output impedance and is not otherwise of significance.

Assuming for simplicity that the value of $L_a$ is chosen to resonate with the capacitance $C_a+C_b/N^2$ at the frequency of interest, and that $L_a$ and the capacitance are ideal (i.e. lossless), the parallel combination of $L_a$ and the capacitance can be regarded as an open circuit. $Z_a$ and $N^2Z_b$ then constitute a potential divider and the available voltage $V_1$ across $L_a$ is given by $$V_1 = \frac{V_a N^2 Z_b}{N^2 Z_b + Z_a} + \frac{N V_b Z_a}{N^2 Z_b + Z_a} \tag{3}$$

From equations (1) and (2)

$$\begin{aligned} V_b &= r\,V \sin (wt + \phi) \\ &= V (\sin wt \cos \phi + \cos wt \sin \phi) \end{aligned} \tag{4}$$

$$\begin{aligned} \therefore \frac{V_b}{V_a} &= \frac{r\,V(\sin wt \cos \phi + \cos wt \sin \phi)}{V \sin wt} \\ &= r \cos \phi + r \cot wt \sin \phi \\ \therefore V_b &= r \cos \phi \cdot V_a \\ &= \text{as } \cot wt \rightarrow 0 \text{ for large } t \end{aligned}$$

substituting for $V_b$ in equation (3) gives $$V_1 = V_a \frac{N^2 Z_b + N Z_a\, r \cos \phi}{N^2 Z_b + Z_a} \tag{5}$$

It can be seen that this gives the required non-zero value of $V_1$ for all values of r and $\phi$ since from equation (5), for $V_1=0$ $$N^2 Z_b + N Z_a\, r \cos \phi = 0$$

$$\cos \phi = -N Z_b / r Z_a \tag{6}$$

By definition, $Z_a$, $Z_b$ and r are all greater than zero Therefore, since $-1 \leqq \cos \phi \leqq 1$ If $N > r\, Z_a/Z_b$ then $V_1$ cannot be zero.

Thus, for any given value of r, $Z_a$ and $Z_b$, the value of N may be chosen so that $V_1$ cannot be zero, whatever is the value of $\phi$.

For example, if $Z_a=Z_b$ and $r=1$, from equation (6) the condition for $V_1=0$ is $\cos \phi = -N$.

If $N>1$ the condition for $V_1=0$ is $\cos\phi>-1$ which is impossible. Therefore $V_1$ is non-zero for all values of $\phi$.

By differentiating equation (5) with respect to N after normalizing to $V_a$ such that $$\overline{V_1}=V_1V_a$$

we obtain:

$$\frac{\partial\overline{V_1}}{\partial N}= \tag{7}$$

$$\frac{2NZ_b(N^2Z_b+Z_a)-N^2Z_b2NZ_b+(N^2Z_b+Z_a)r\cos\phi\cdot Z_a}{(N^2Z_b+Z_a)^2}-\frac{NZ_a+\cos\phi\cdot 2NZ_b}{(N^2Z_b+Z_a)^2}$$

Setting $\partial\overline{V}_1/\partial N$ to zero and solving for N then gives the value of N to maximize $V_1$ for given values of r, $\phi Z_a$ and $Z_b$.

Whilst equation (7) may in theory be used to find the value of N to maximize the average value of $V_1$ for all values of r, $\phi$, $Z_a$ and $Z_b$, in practice it is more convenient to obtain a value for N graphically or experimentally. Values of N close to two are found to give good results.

It will be understood that for the circuit of FIG. 1 the values of $Z_a$ and $Z_b$ vary across the range of operating frequencies of the antenna 1, and also depend on the design of the amplifiers incorporating transistors T1 and T2, $Z_a$ and $Z_b$ effectively being the output impedances of these tow amplifiers respectively. Furthermore, the relative gains of these two amplifiers may be varied to alter r as required.

It will further be understood that the output $V_o$ may be derived from the winding 37 of transformer 41 instead of winding 39, i.e. from $L_a$ in FIG. 2 instead of from $L_b$.

It will be appreciated that whilst the design approach used for the combining circuit in FIG. 1 comprises unbalancing the differential-mode rejection mechanism of a common-mode selection circuit, the complementary approach i.e. unbalancing the common-mode rejection mechanism of a differential-mode selection circuit may alternatively be used.

Figure 4:
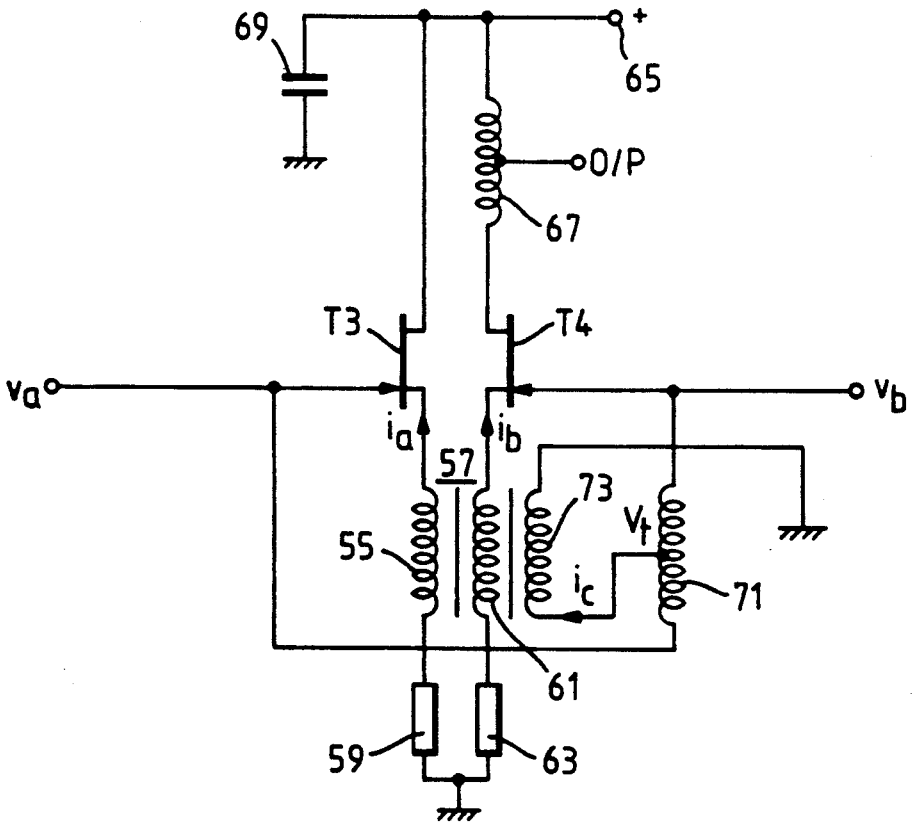
FIG. 4 is a circuit diagram of a combining circuit used in the second system.

FIG. 4 shows the circuit diagram of a combining circuit using the above complementary approach, which may be used in the antenna system of FIG. 1 in place of the combining circuit comprising transformer 41 and the amplifiers incorporating transistors T1 and T2 of FIG. 1.

Referring to FIG. 4, the circuit includes two field-effect transistors T3 and T4 to whose gates the signals $v_a$ and $v_b$ are respectively applied. The source of one transistor T3 is grounded via the series connection of a first winding 55 of a transformer 57 and a resistor 59 and the source of the other transistor T4 is grounded via the series connection of a second winding 61 of the transformer 57 and a resistor 63.

The drain of the transistor T3 is connected to a terminal 65 maintained at a positive potential with respect to ground for the supply of energizing current to the transistors T3 and T4, and the drain of the transistor T4 is connected to the terminal 65 via an inductor 67 from a tapping point on which the output of the circuit is derived. The terminal 65 is grounded with respect to radio frequencies via a capacitor 69.

An inductor 71 is connected between the gates of the transistors T3 and T4 and a third winding 73 of the transformer 57 is connected between a tapping point on the inductor 71 and ground.

The circuit will be seen to comprise effectively a differential amplifier with inductor 71 and the third winding 73 of transformer 57 added.

considering the operation of the circuit without inductor 71 and winding 73, when the signals $v_a$ and $v_b$ are in anti-phase, transistors T3 and T4 caused currents $i_a$ and $i_b$ to flow in windings 55 and 61 respectively. The relative sense of the windings 55 and 61 is such that these currents produce fluxes of opposite senses so that the windings 55 and 61 present small impedances to these currents. The current $i_b$ therefore develops an appreciable voltage across inductor 67 and hence at the circuit output. The inductor 67 could of course equally well be connected in series with transistor T3.

When the signals $v_a$ and $v_b$ are in phase, the currents $i_a$ and $i_b$ produce fluxes in the same sense so that windings 55 and 61 present high impedances to these currents limiting them to very small values with resultant very small voltages across inductor 67 and at the circuit output.

Considering now the effect of the presence of inductor 71 and winding 73, the inductor 71 is of such a value as to present a large impedance. The parts of inductor 71 on either side of its tap may be considered as a voltage divider setting the tap voltage $v_t$ to a value $$v_t=\frac{v_a+v_b}{2}$$

For $v_a$ and $v_b$ in anti-phase, and $r=1$, $v_a=-v_b$ $$\therefore v_t=0$$

For impure or balanced modes where r is other than one, the position of the tap may be adjusted to give $v_t=0$.

Thus for $v_a$ and $v_b$ in anti-phase, no current flows in winding 73 and the output of the circuit is unaffected.

However, when $v_a$ and $v_b$ are in phase, i.e. when $v_b=r\,v_a$ $$V_t=\frac{1+r}{2}v_a$$

As a result a current $i_c$ flows in winding 73. The sense of the winding 73 with respect to the windings 55 and 61 is such that the flux produced by the current $i_c$ opposes that produced by currents $i_a$ and $i_b$ and therefore the impedances of windings 55 and 61 are reduced and appreciable voltages are produced across inductor 67 and at the circuit output.

Thus an appreciable output voltage is produced for all values of $\phi$.

It will be appreciated that the turns ratio between windings 55, 61 and 73 may be adjusted to optimize output under given operating conditions.

It should be understood that whilst in the antenna systems described above by way of example the antenna arrangement comprises a single antenna which operates in different modes to produce the combined signals, in other systems according to the invention the antenna arrangement may comprise two separate antennas having different reception characteristics.

It should be further understood that whilst in the antenna systems described above by way of example the antenna arrangement produces only tow signals which are combined, in other systems according to the invention the antenna arrangement may produce more than two signals all of which are combined. For example, in a system wherein the antenna arrangement produces three signals, two of these signals may be combined by a first combining circuit, for example as shown in FIG. 1 or FIG. 4, and the combined signal then combined with the third signal by a second such combining circuit.

I claim:

1. A radio receiver antenna system comprising: an antenna arrangement having first and second terminals at each of which there appears, in response to reception by the antenna arrangement of a transmitted signal of a given predetermined frequency, a respective one of first and second signals of said predetermined frequency, said first and second signals respectively having phases which differ from one another by different amounts under different reception conditions; and combining means connected with said first and second terminals to produce an output signal of said predetermined frequency, said output signal being a combination of said first and second signals at said first and second terminals and having a non-zero amplitude irrespective of the difference in phase between said first and second signals at said first and second terminals, said combining means comprising a radio frequency transformer having two windings across which said first and second signals are respectively applied, said windings having a non-unity turns ratio, and a tapping point on one of the windings constituting an output terminal for the output signal.

2. An antenna system according to claim 1 wherein said two windings produce fluxes that are substantially anti-phase when said first and second signals are in-phase, and that are substantially in-phase when said first and second signals are anti-phase.

3. An antenna system according to claim 1 wherein said windings have a turns ratio of substantially two.

4. An antenna system according to claim 1 wherein said first and second signals are signals produced by a single antenna operating in different modes.

5. An antenna system according to claim 4 wherein said antenna is constituted by an electrical resistance vehicle window heater.

6. A radio receiver antenna system comprising: an antenna arrangement having first and second terminals at each of which there appears, in response to reception by the antenna arrangement of a transmitted signal of a given predetermined frequency, a respective one of first and second signals of said predetermined frequency, said first and second signals respectively having phases which differ from one another by different amounts under different reception conditions; and combining means connected with said first and second terminals to produce an output signal of said predetermined frequency, said output signal being a combination of said first and second signals at said first and second terminals and having a non-zero amplitude irrespective of the difference in phase between said first and second signals at said first and second terminals, said combining means comprising a differential amplifier circuit arrangement comprising: a pair of amplifying elements, each having a main current path and a control electrode, each of said first and second signals being respectively applied to the control electrode of a respective one of the amplifying elements; a radio frequency transformer including first, second and third windings having senses and producing fluxes, said first and second windings being respectively connected in series with a main current path through a respective one of said amplifying elements, the sense of the first winding relative to the second winding being such that the phase of the flux produced by said first winding relative to the phase of the flux produced by said second winding is substantially the same as the phase of the first signal relative to the second signal; an impedance connected between the control electrodes of said amplifying elements, said third winding of said transformer being connected between a tapping point on said impedance and a point maintained at a reference potential, the sense of said third winding relative to the senses of said first and second windings being such that when said first and second signals are in phase said third winding produces a flux that opposes the fluxes produced by said first and second windings; and means for deriving the output signal from another impedance connected in series with the main current path through one of the amplifying elements.

7. An antenna system according to claim 6 wherein said first and second signals are signals produced by a single antenna operating in different modes.

8. An antenna system according to claim 7 wherein said antenna is constituted by an electrical resistance vehicle window heater.

* * * * *